US011545783B2

(12) United States Patent
Kida et al.

(10) Patent No.: US 11,545,783 B2
(45) Date of Patent: Jan. 3, 2023

(54) CONNECTOR LOCK STRUCTURE

(71) Applicant: Yazaki Corporation, Tokyo (JP)

(72) Inventors: Kousuke Kida, Makinohara (JP); Hiromasa Kubota, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 40 days.

(21) Appl. No.: 17/333,742

(22) Filed: May 28, 2021

(65) Prior Publication Data

US 2021/0376522 A1 Dec. 2, 2021

(30) Foreign Application Priority Data

May 29, 2020 (JP) ..... JP2020-094302

(51) Int. Cl.
*H01R 13/627* (2006.01)
*H01R 13/633* (2006.01)

(52) U.S. Cl.
CPC ..... *H01R 13/6272* (2013.01); *H01R 13/6335* (2013.01)

(58) Field of Classification Search
CPC ..... H01R 13/6272; H01R 13/6335; H01R 13/639
See application file for complete search history.

(56) References Cited

U.S. PATENT DOCUMENTS

2001/0049219 A1* 12/2001 Torii ..... H01R 13/641 439/352
2004/0142594 A1* 7/2004 Endo ..... H01R 13/641 439/489
2007/0099496 A1* 5/2007 Shigeta ..... H01R 13/641 439/557
2007/0155209 A1* 7/2007 Takahashi ..... H01R 13/6272 439/157
2008/0153341 A1* 6/2008 Shigeta ..... H01R 13/6272 439/352
2010/0111597 A1* 5/2010 Kodama ..... H01R 13/6272 403/341
2014/0017927 A1* 1/2014 Kida ..... H01R 13/506 439/350
2014/0179146 A1* 6/2014 Hamai ..... H01R 13/639 439/357

(Continued)

FOREIGN PATENT DOCUMENTS

JP 2006-216322 A 8/2006
JP 2019-114488 A 7/2019

*Primary Examiner* — Abdullah A Riyami
*Assistant Examiner* — Nelson R. Burgos-Guntin
(74) *Attorney, Agent, or Firm* — Sughrue Mion, PLLC

(57) ABSTRACT

A connector lock structure includes: a lock arm extending from a front end to a rear end in a fitting direction and formed on a side wall of a connector housing; a pair of plate-shaped support walls provided at a rear portion of the side wall to protrude from the side wall and sandwiching a rear portion of the lock arm therebetween; a connecting portion that connects upper ends of the pair of plate-shaped support walls in a width direction to cross over the rear portion of the lock arm; and a lock operation space having a cut formed at a rear end of the connecting portion. A rear end of one of the pair of plate-shaped support walls is located closer to the front end of the lock arm than the rear end of the lock arm in the fitting direction.

7 Claims, 8 Drawing Sheets

(56) References Cited

U.S. PATENT DOCUMENTS

| | | | | |
|---|---|---|---|---|
| 2016/0164224 | A1* | 6/2016 | Sekino | H01R 13/6272 439/352 |
| 2016/0204551 | A1* | 7/2016 | Kanda | H01R 13/633 439/372 |
| 2017/0012388 | A1* | 1/2017 | Sasaki | H01R 13/424 |
| 2017/0018874 | A1* | 1/2017 | Kida | H01R 13/5216 |
| 2018/0034206 | A1* | 2/2018 | Sekino | H01R 13/641 |
| 2018/0076566 | A1* | 3/2018 | Kanda | H01R 13/62966 |
| 2018/0226748 | A1* | 8/2018 | Hayasaka | H01R 13/641 |
| 2018/0351281 | A1* | 12/2018 | Takamura | H01R 13/113 |
| 2019/0044278 | A1* | 2/2019 | Amemiya | H01R 13/641 |
| 2019/0103705 | A1* | 4/2019 | Amemiya | H01R 13/641 |
| 2019/0199036 | A1 | 6/2019 | Kanemura et al. | |
| 2019/0280425 | A1* | 9/2019 | Baba | H01R 13/6272 |
| 2019/0305444 | A1* | 10/2019 | Hibino | H01R 13/428 |
| 2020/0106212 | A1* | 4/2020 | Endo | H01R 13/6273 |
| 2020/0136310 | A1* | 4/2020 | Nishiyama | H01R 13/6272 |
| 2020/0153149 | A1* | 5/2020 | Tanaka | H01R 13/6272 |
| 2020/0203890 | A1* | 6/2020 | Ohfuku | H01R 13/6275 |
| 2020/0251848 | A1* | 8/2020 | Misaiji | H01R 13/5025 |
| 2020/0321725 | A1* | 10/2020 | Ikeya | H01R 13/6272 |
| 2020/0321726 | A1* | 10/2020 | Ikeya | H01R 13/6272 |
| 2020/0388958 | A1* | 12/2020 | Ikeya | H01R 13/6272 |
| 2021/0226383 | A1* | 7/2021 | Saito | H01R 13/641 |
| 2021/0281013 | A1* | 9/2021 | Kida | H01R 13/6272 |
| 2021/0376522 | A1* | 12/2021 | Kida | H01R 13/6272 |
| 2021/0408713 | A1* | 12/2021 | Kida | H01R 13/4223 |
| 2022/0052484 | A1* | 2/2022 | Nakamura | H01R 13/631 |

* cited by examiner

CONNECTOR LOCK STRUCTURE

CROSS-REFERENCE TO RELATED APPLICATIONS

This application claims the benefit of priority of Japanese Patent Application No. 2020-094302 filed on May 29, 2020, the entire contents of which are incorporated herein by reference.

FIELD

The present disclosure relates to a connector lock structure.

BACKGROUND

An example of a connector lock structure allows a connector housing and a counterpart connector housing to be held in a fitted state (see, for example, JP-A-2006-216322).

As illustrated in FIG. 8, the connector lock structure disclosed in JP-A-2006-216322 includes a lock arm 515 provided on an upper surface of a female housing 510 and having a lock protrusion 515A, protective walls 516 provided on both sides of the lock arm 515, and an anti-reverse wall (connecting portion) 518 which prevents the lock arm 515 from rolling up to cross over an operation portion 515F of the lock arm 515.

The anti-reverse wall 518 is connected to an upper surface of the female housing 510 by a support wall 518A. The anti-reverse wall 518 is formed with a finger through hole (lock operation space) 518B opened at a rear end so that the finger can press the operation portion 515F.

SUMMARY

However, in the connector lock structure described above, when a width dimension of the female housing 510 is reduced due to miniaturization of the connector, a gap between the support walls 518A on both sides supporting the anti-reverse wall 518 are narrowed. Then, when the gap between the support walls 518A on both sides are narrowed, a width of the finger through hole 518B opened at the rear end of the anti-reverse wall 518 is also narrowed. Consequently, in the miniaturized connector, the finger may hit the support walls 518A on both sides during unlocking operation, which may make it difficult to press the finger against the operation portion 515F. Therefore, the related-art structure may lead reduction of an unlocking property.

The disclosure has been made in view of the above circumstances and an object thereof is to provide a lock structure of a compact connector capable of ensuring workability at the time of unlocking operation while protecting a lock arm.

The present disclosure provides a connector lock structure including: a lock arm extending from a front end to a rear end in a fitting direction and formed on a side wall of a connector housing, the lock arm being configured to hold a fitted state by elastically engaging a counterpart connector housing; a pair of plate-shaped support walls provided at a rear portion of the side wall to protrude from the side wall, the pair of plate-shaped support walls sandwiching a rear portion of the lock arm therebetween; a connecting portion that connects upper ends of the pair of plate-shaped support walls in a width direction to cross over the rear portion of the lock arm; and a lock operation space having a cut formed at a rear end of the connecting portion, wherein a rear end of one of the pair of plate-shaped support walls is located closer to the front end of the lock arm than the rear end of the lock arm in the fitting direction.

According to the connector lock structure according to the disclosure, it is possible to provide a lock structure of a compact connector capable of ensuring workability at the time of unlocking operation while protecting the lock arm.

The disclosure is briefly described above. The details of the disclosure will be further clarified by reading through the description of embodiment (hereinafter referred to as "embodiment") described below with reference to the accompanying drawings.

DETAILED DESCRIPTION

Hereinafter, an embodiment according to the disclosure will be described with reference to the drawings.

Figure 1:
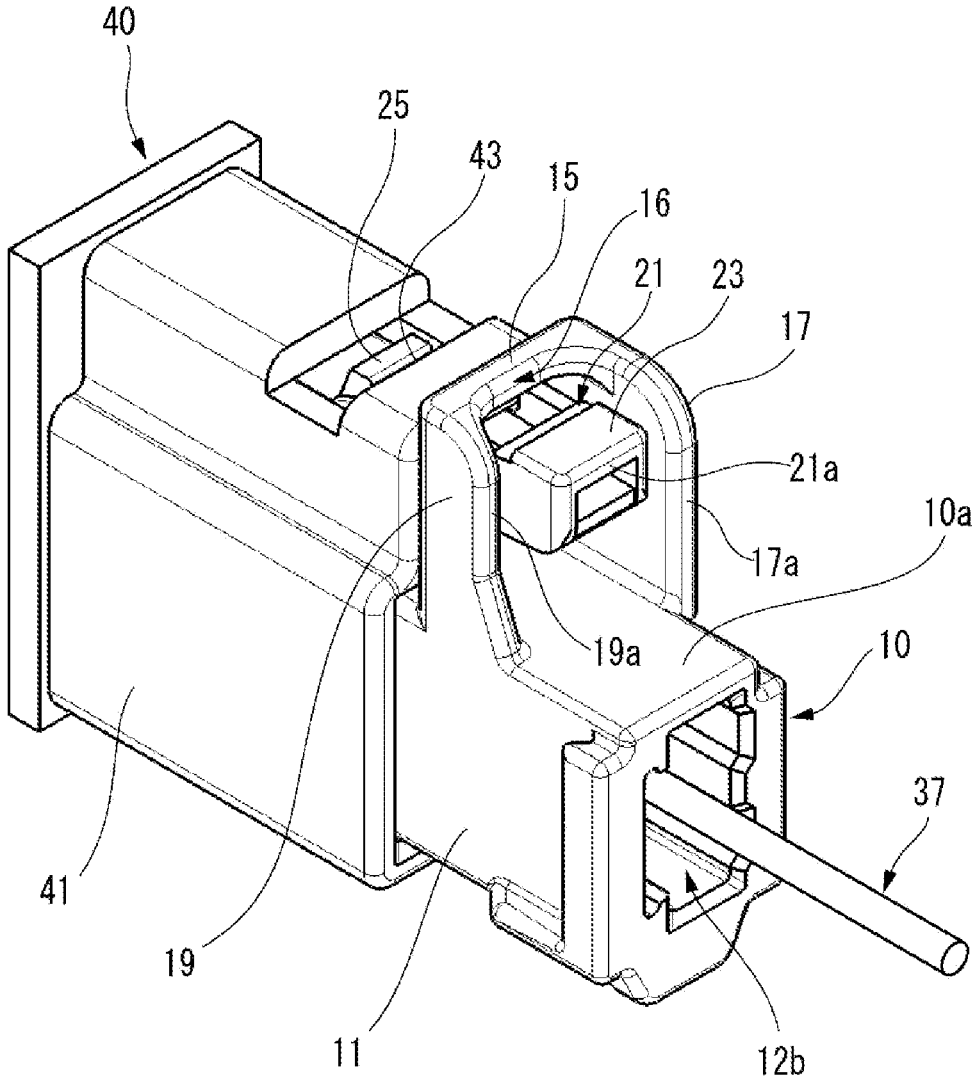
FIG. 1 is a perspective view illustrating a fitted state of a connector housing and a counterpart connector housing forming a connector lock structure according to an embodiment of the disclosure.
Figure 2A:
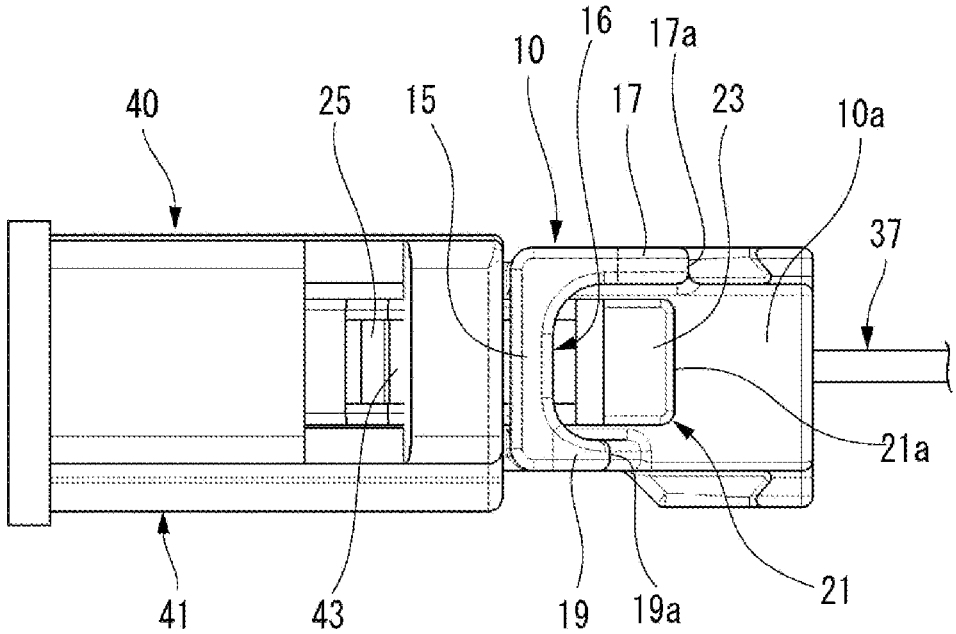
FIGS. 2A and 2B are a top view and a side view of the connector housing and the counterpart connector housing illustrated in FIG. 1.
Figure 2B:
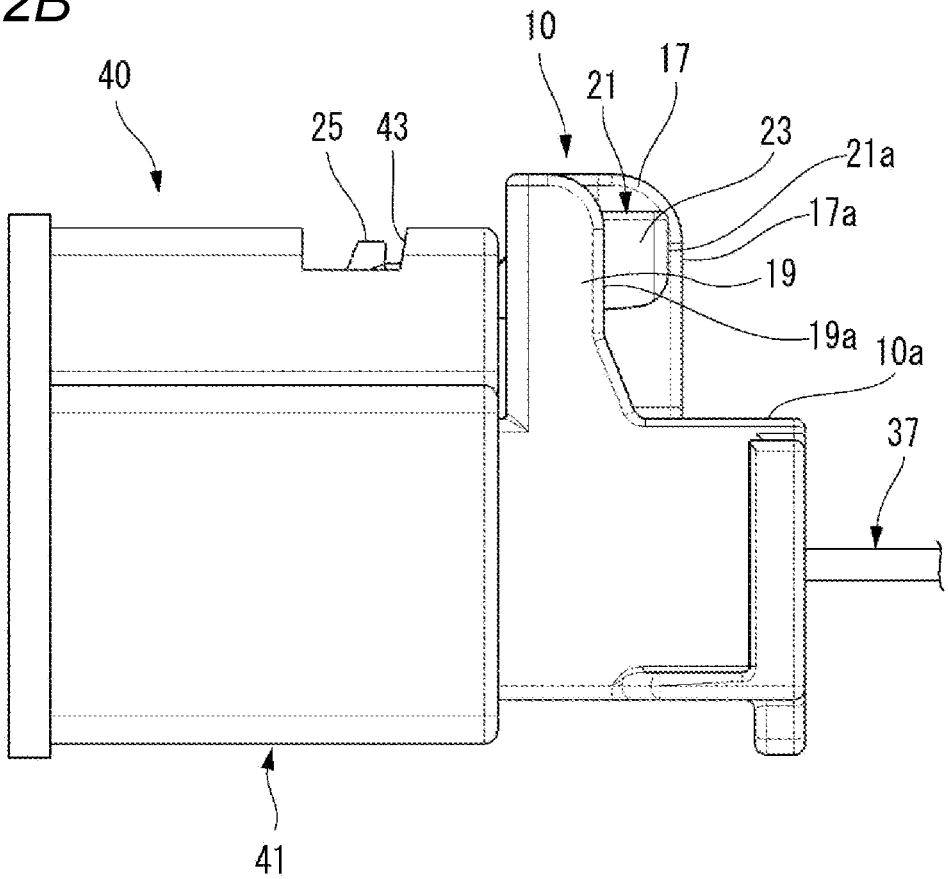

FIG. 1 is a perspective view illustrating a fitted state of a connector housing 10 and a counterpart connector housing 40 forming a connector lock structure according to the embodiment of the disclosure. FIGS. 2A and 2B are a top view and a side view of the connector housing 10 and the counterpart connector housing 40 illustrated in FIG. 1.

As illustrated in FIGS. 1 and 2, the connector lock structure according to the embodiment includes the connector housing 10 and the counterpart connector housing 40. Here, the connector housing 10 is a female connector housing in which a female terminal 31 is accommodated in a terminal accommodation chamber 12. The counterpart connector housing 40 is a male connector housing in which a male terminal (not illustrated) is arranged in a connector fitting portion 41. In the following description, a side (left side in FIG. 2) which fits into the counterpart connector housing 40 is a front side of the connector housing 10.

The connector lock structure according to the embodiment includes a lock arm 21 formed on an upper wall (side wall) 10*a* of the connector housing 10, a pair of plate-shaped support walls 17 and 19 provided at a rear portion of the upper wall 10*a* to protrude from the upper wall 10*a* to sandwich a rear portion of the lock arm 21 therebetween, a connecting portion 15 which connects upper ends of the pair of plate-shaped support walls 17 and 19 in a width direction (up-down direction in of FIG. 2A) to cross a rear portion of the lock arm 21, a lock operation space 16 having a cut formed at a rear end of the connecting portion 15 so that an operator such as a finger can press a rear portion of the lock arm 21, and a rear end 19*a* of one plate-shaped support wall 19 set to be located further on a front side in a fitting direction than a rear end 21*a* of the lock arm 21 as a main configuration.

As illustrated in FIGS. 1 and 2, the counterpart connector housing 40 of the embodiment is formed as a molded product of synthetic resin and has a rectangular-shaped tubular connector fitting portion 41. A fitting portion 11 of the connector housing 10, which will be described below, is inserted and fitted into the connector fitting portion 41 in a substantially close contact state. On a back wall of the connector fitting portion 41, a tab terminal portion of a male terminal is protrudes toward an open end.

A lock portion 43 formed with a cut is provided on a top wall of the connector fitting portion 41. The lock claw (locking protrusion) 25 of the lock arm 21, which will be described below, is locked to the lock portion 43.

Figure 3A:
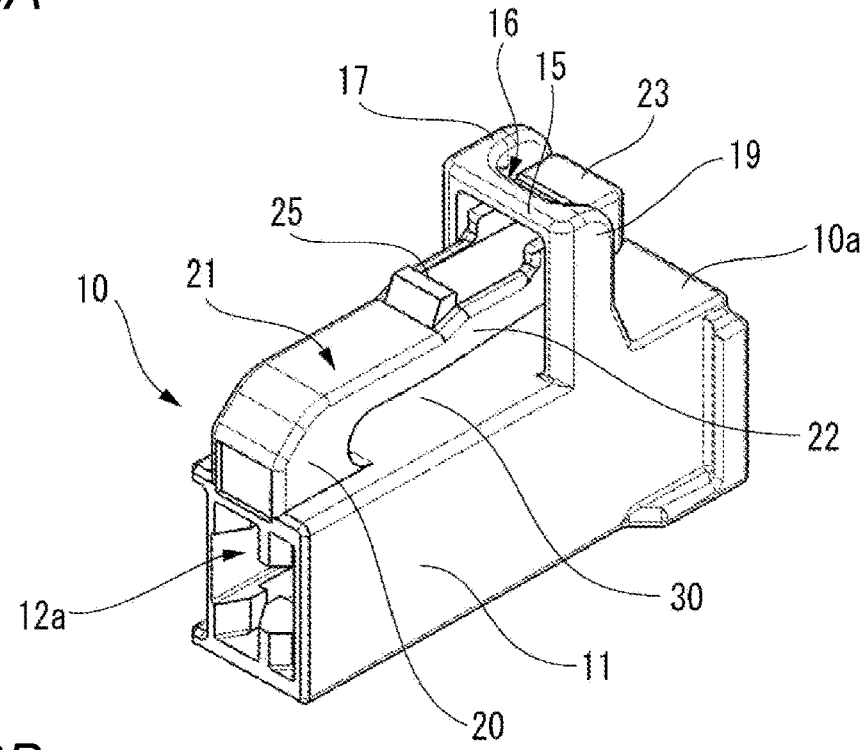
FIG. 3A is a perspective view of the connector housing illustrated in FIG. 1 as viewed from a front side and FIG. 3B is a perspective view before inserting a terminal into the connector housing illustrated in FIG. 1.
Figure 3B:
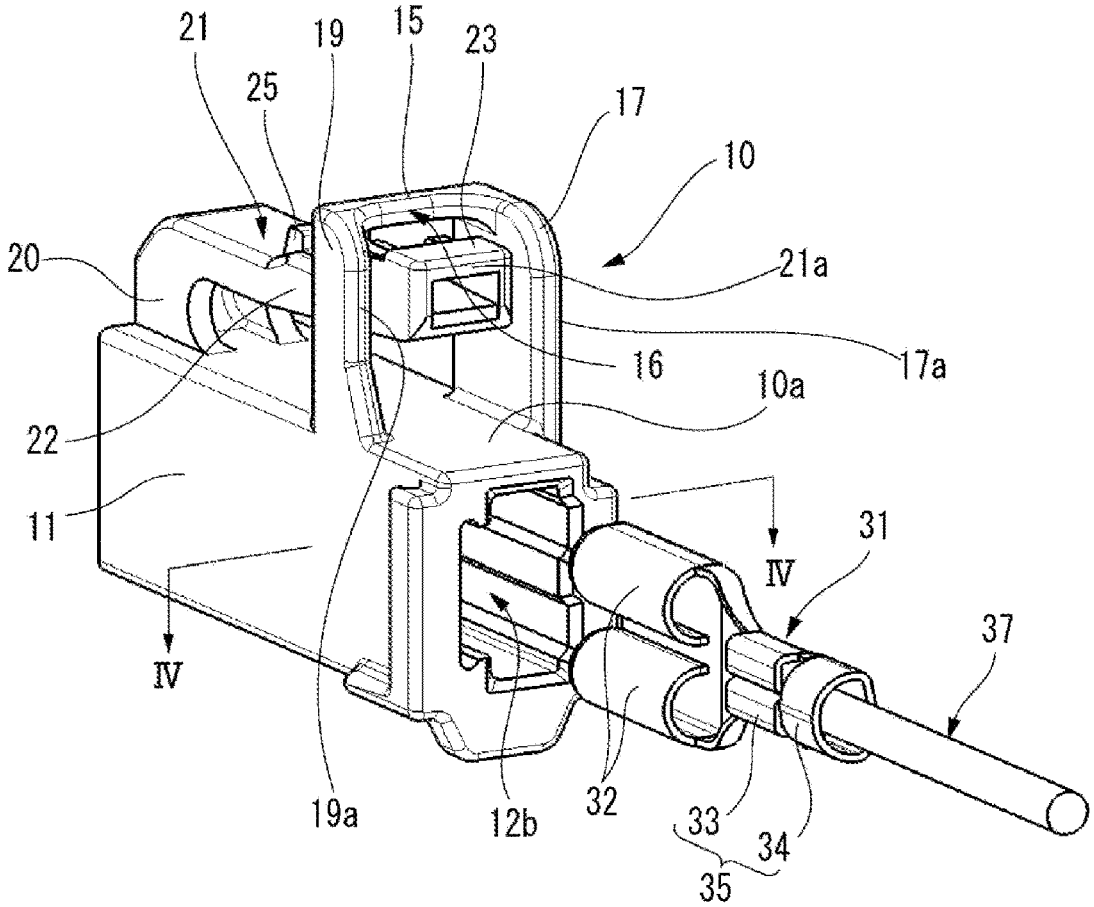
Figure 4:
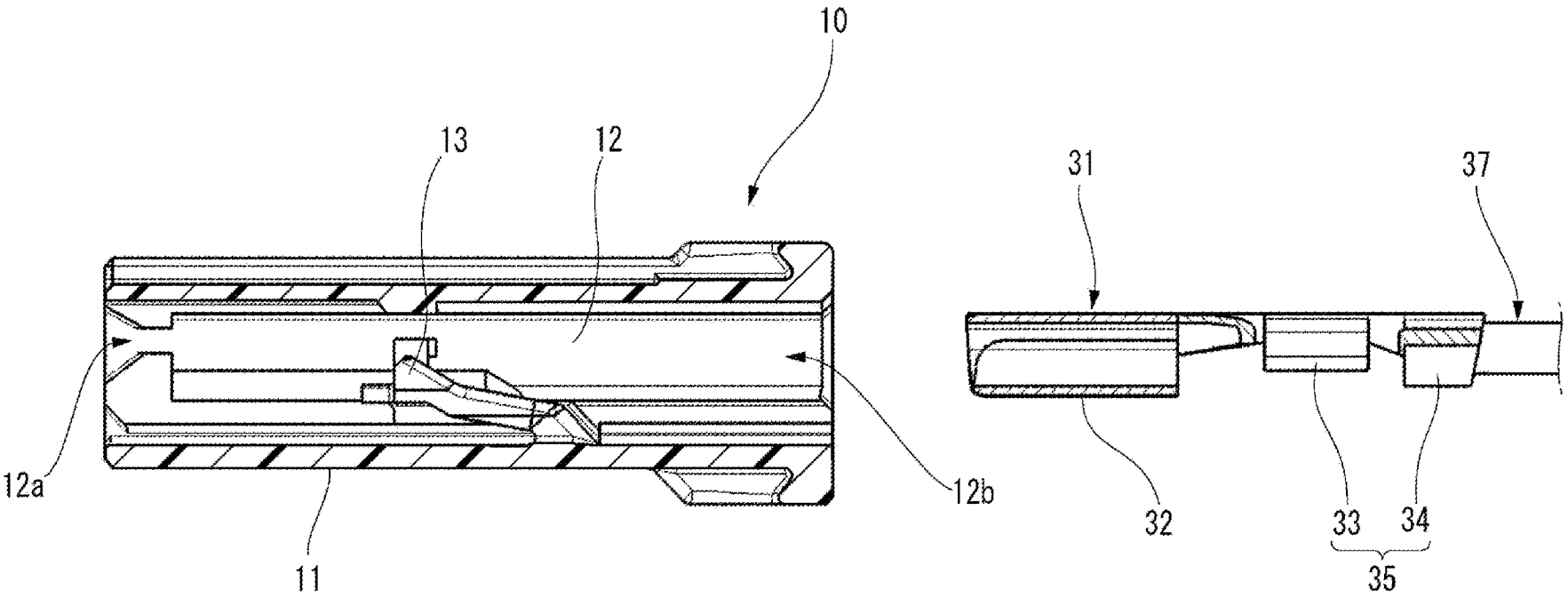
FIG. 4 is a cross-sectional view taken along the line IV-IV in FIG. 3B.
Figure 5:
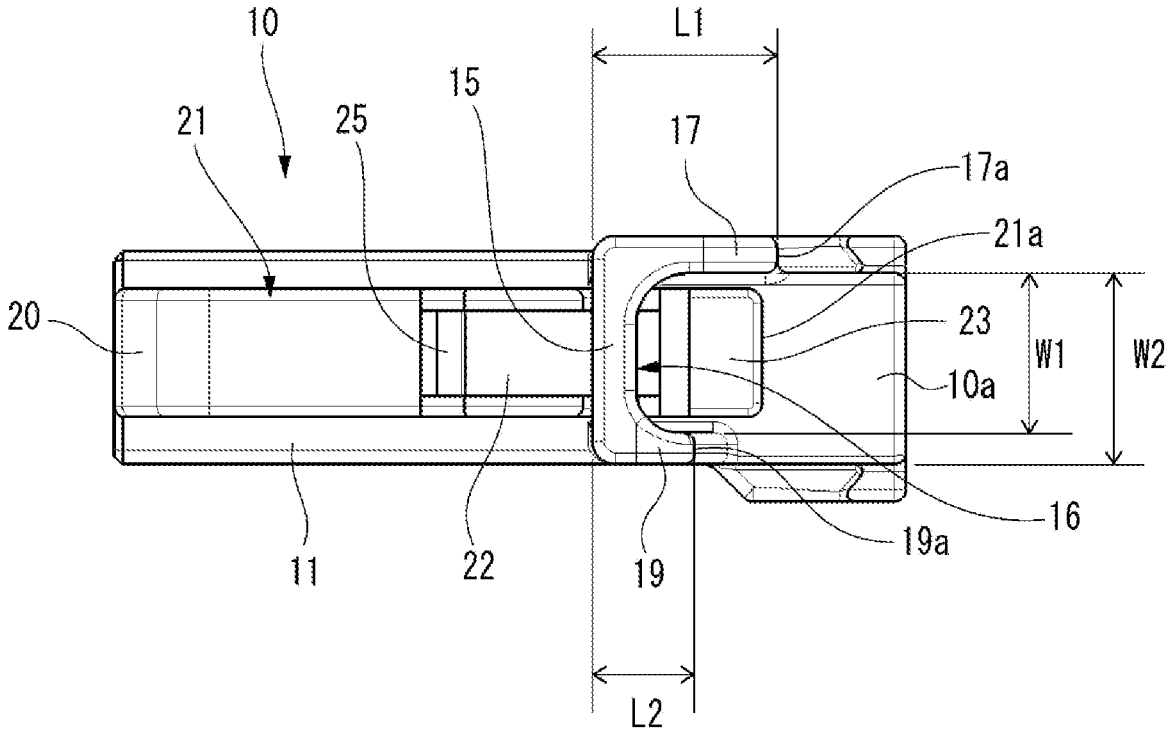
FIG. 5 is a top view of the connector housing illustrated in FIG. 3A.

FIG. 3A is a perspective view of the connector housing 10 illustrated in FIG. 1 as viewed from a front side and FIG. 3B is a perspective view before inserting the female terminal 31 into the connector housing 10 illustrated in FIG. 1. FIG. 4 is a cross-sectional view taken along the line Iv-Iv in FIG. 3B. FIG. 5 is a top view of the connector housing 10 illustrated in FIG. 3A.

As illustrated in FIGS. 3A to 5, the connector housing 10 of the embodiment is formed as a molded product made of synthetic resin and has a substantially rectangular tubular shape as a whole. A front half of the connector housing 10 is the fitting portion 11 which can be inserted into the connector fitting portion 41 of the counterpart connector housing 40. The inside of the connector housing 10 including the fitting portion 11 is the terminal accommodation chamber 12 of the female terminal 31 which receives a male terminal of the counterpart connector housing 40 via a front end opening 12*a*.

As illustrated in FIG. 4, a cantilever-shaped lance 13 for retaining the female terminal 31 is provided in the terminal accommodation chamber 12 and the female terminal 31 inserted from a rear end opening 12*b* of the connector housing 10 is held by the lance 13.

As illustrated in FIG. 3B, the female terminal 31 has, for example, a pair of elastic curl portions 32 serving as electrical contact portions at a tip in an insertion direction. The elastic curl portions 32 are formed on both sides of a substrate portion by being bent inward in a substantially mountain-shaped cross section. In the female terminal 31, a wire crimping portion 35 including a conductor crimping portion 33 for crimping conductor of an electric wire 37 and a covering crimping portion 34 for fixing the electric wire 37 is continuously provided behind the elastic curl portion 32.

As illustrated in FIGS. 3A and 3B, the upper wall 10*a* of the connector housing 10 is formed with the lock arm 21 which holds a fitted state by elastically engaging the counterpart connector housing 40.

The lock arm 21 includes a cantilever-shaped arm portion 22 extending rearward at intervals from a base end portion 20 raised from the upper wall 10*a* of the connector housing 10 to the upper wall 10*a* of the connector housing 10. Between the upper wall 10*a* of the connector housing 10 and a lower surface of the arm portion 22, a bending space (void) 30 which allows bending deformation of the arm portion 22 at the time of fitting with the counterpart connector housing 40 is provided.

Therefore, a rear end portion (free end portion) of the lock arm 21 receives an operating force and bends and deforms in a pressing direction (downward in FIGS. 3A and 3B), and when the operating force is removed, an original cantilever shape is restored by its own repulsive force. The lock arm 21 has the lock claw 25 locked to the lock portion 43 of the counterpart connector housing 40 on an upper surface in a middle portion of the arm portion 22. A lock operation portion 23 protruding upward is provided on an upper surface of the rear end portion of the arm portion 22.

That is, the lock arm 21 maintains the fitted state of the connector housing 10 and the counterpart connector housing 40 by locking the lock claw 25 to the lock portion 43 of the counterpart connector housing 40. In the lock arm 21, when the lock operation portion 23 is pushed downward by an operator such as a finger, the operation force is intensively applied to the lock operation portion 23, and thus the rear end portion is bent and deformed downward.

The pair of plate-shaped support walls 17 and 19 according to the present embodiment are provided to protrude upward on a rear side of the upper wall 10*a* to sandwich therebetween the rear end portion of the lock arm 21 including the lock operation portion 23 in the width direction. The pair of plate-shaped support walls 17 and 19 are arranged in parallel with a gap W1 having a slight gap with respect to both side surfaces of the lock arm 21.

As illustrated in FIG. 5, one plate-shaped support wall 19 is set so that the rear end 19*a* is located further on a front side than the rear end 21*a* of the lock arm 21 in the fitting direction. That is, the other plate-shaped support wall 19 has a shorter length L2 in the fitting direction, compared to a length L1 in the fitting direction of the other plate-shaped support wall 17 set so that the rear end 17*a* is located further on a rear side than the rear end 21*a* of the lock arm 21 in the fitting direction.

In the connecting portion 15 of the embodiment, upper ends of the pair of plate-shaped support walls 17 and 19 are connected in the width direction to cross the rear portion of the lock arm 21. At the rear end of the connecting portion 15, the lock operation space 16 is formed so that a finger 50 can be pressed against the lock operation portion 23 of the lock arm 21.

The lock operation space 16 of the embodiment is opened so that the entire upper surface of the lock operation portion 23 is exposed in a top view. The lock operation space 16 is formed by cutting the connecting portion 15 in which the upper ends of the pair of plate-shaped support walls 17 and 19 having different lengths are connected in the width direction. Therefore, the lock operation space 16 has an opening space W2 wider than the gap W1 of the pair of plate-shaped support walls 17 and 19 on the one plate-shaped support wall 19 side where the length L2 in the fitting direction is shorter than the length L1 of the other plate-shaped support wall 17.

Next, an operation of the configuration described above will be described.

Figure 6:
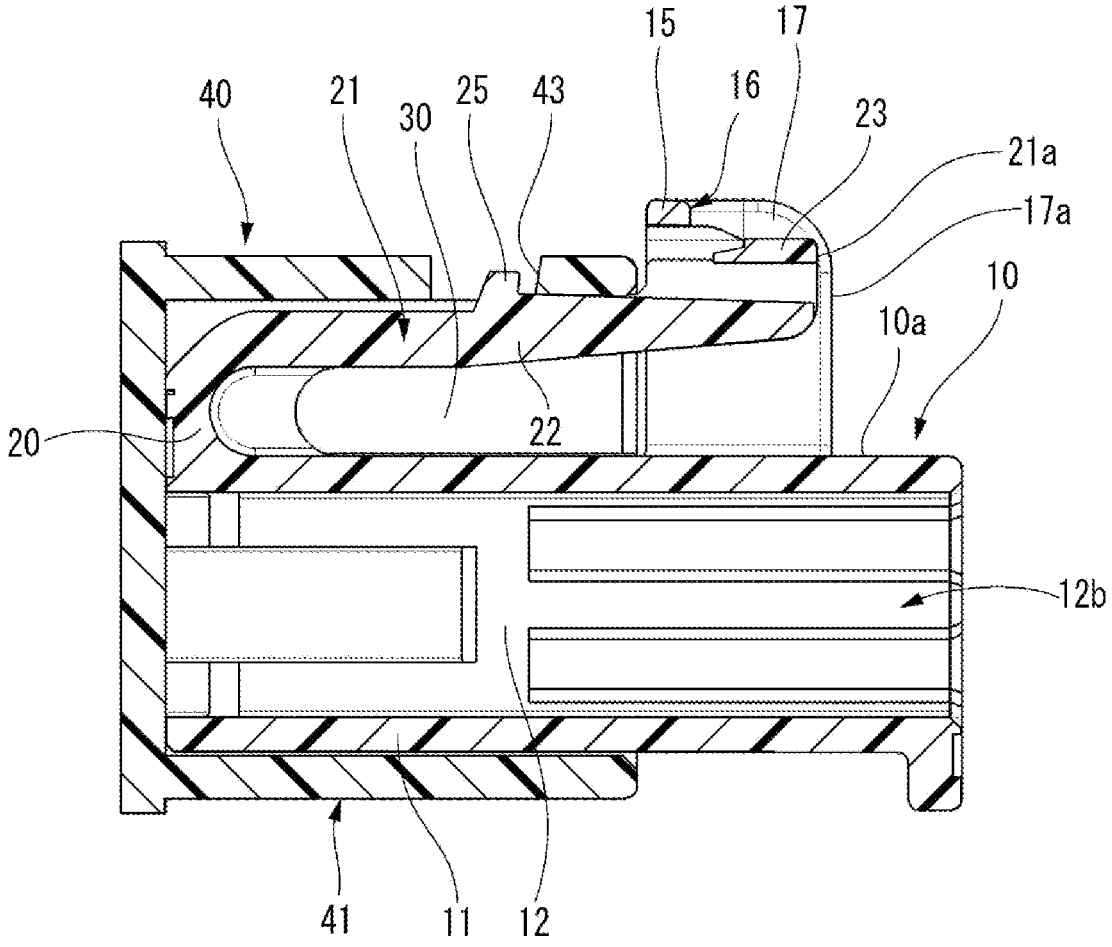
FIG. 6 is a vertical cross-sectional view of the connector housing and the counterpart connector housing illustrated in FIG. 1.
Figure 7A:
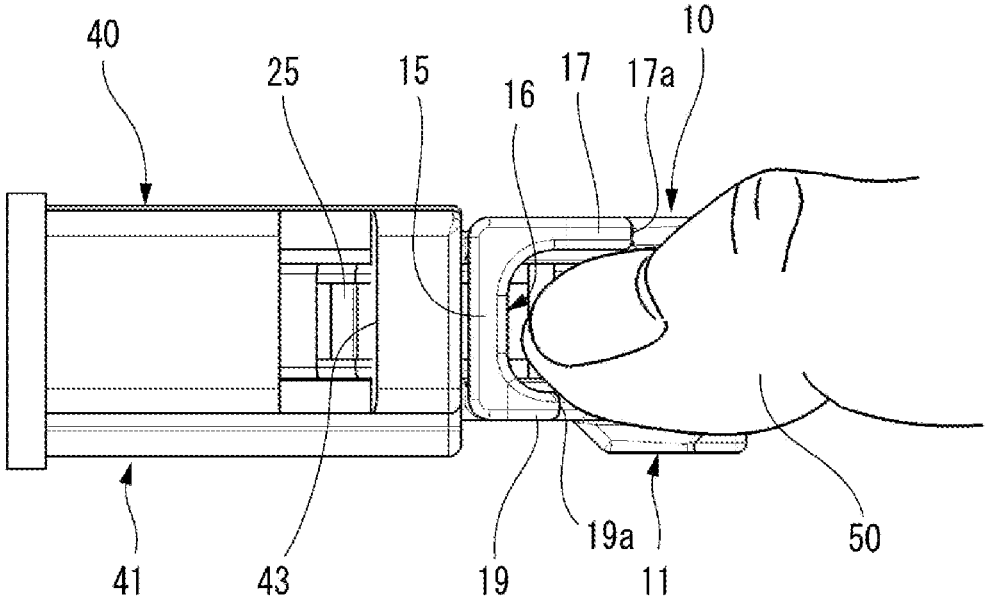
FIGS. 7A and 7B are explanatory views for explaining an unlocking operation of the connector housing illustrated in FIG. 6.
Figure 7B:
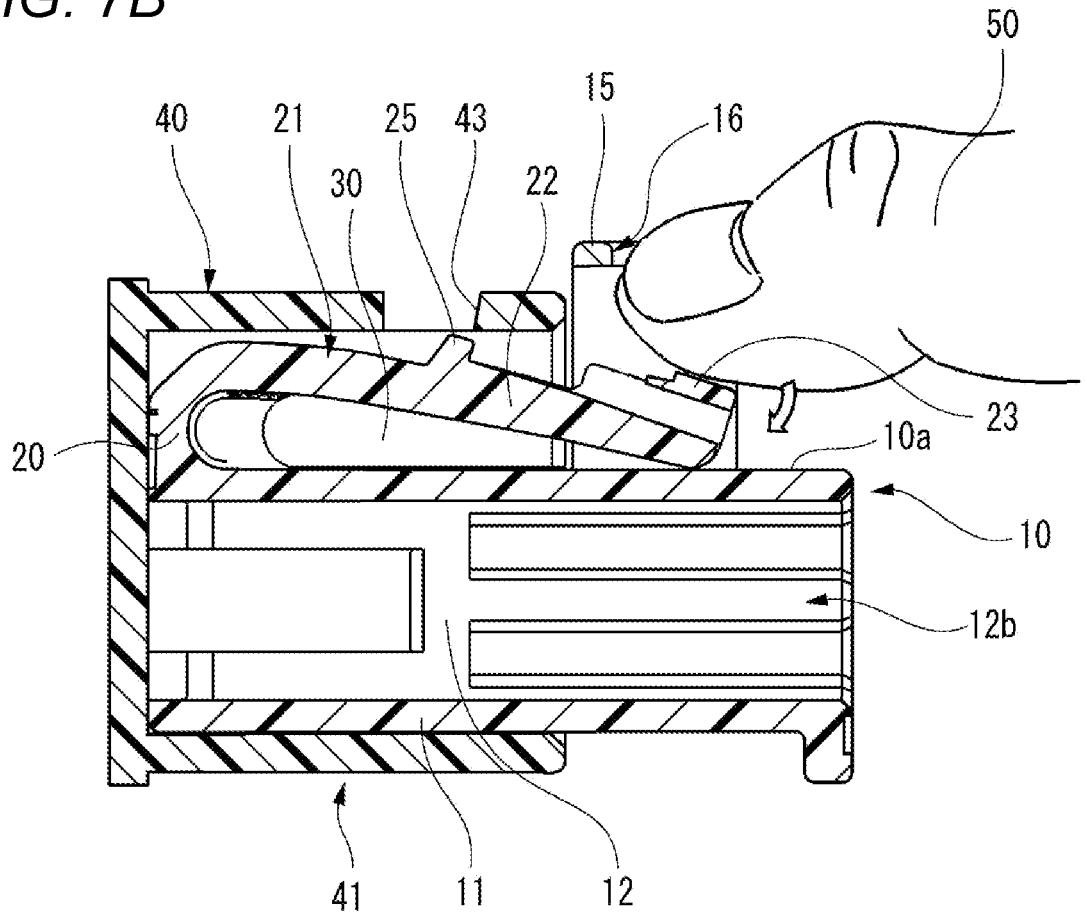
Figure 8:
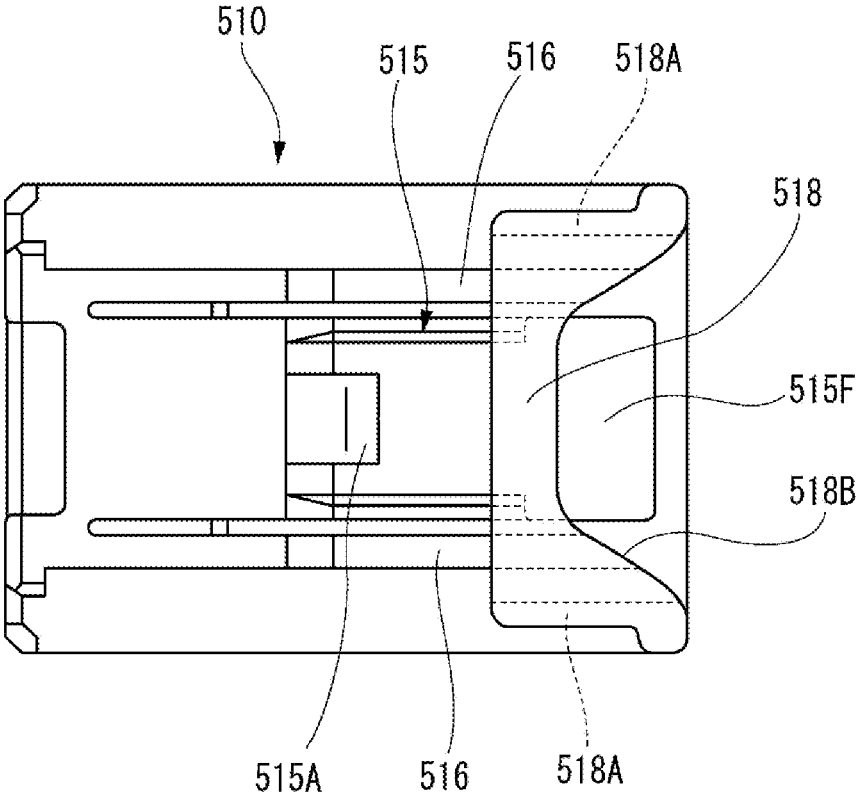
FIG. 8 is a plan view of a connector of the related art.

FIG. 6 is a vertical cross-sectional view of the connector housing 10 and the counterpart connector housing 40 illustrated in FIG. 1. FIGS. 7A and 7B are explanatory views for explaining an unlocking operation of the connector housing 10 illustrated in FIG. 6.

According to the connector lock structure according to the embodiment, as illustrated in FIGS. 1, 2A, 2B, and 6, when an undesired external force directed downward from above is applied to the lock arm 21, for example, when an object hits the lock arm 21, the external force is received by the pair of plate-shaped support walls 17 and 19 provided to sandwich the rear portion of the lock arm 21 therebetween. Therefore, the lock arm is prevented from being bent by an external force. Therefore, the pair of plate-shaped support walls 17 and 19 prevent the situation in which an external force is applied to the lock arm 21 of the connector housing 10 and the bending of the lock arm itself disengages it from the counterpart connector housing 40, and further the fitted state is impaired from occurring.

When an undesired external force directed upward from below is applied to the lock arm 21, for example, when a rear portion of the lock arm 21 is caught in an object, the external force is received by the connecting portion 15 which connects the upper ends of the pair of plate-shaped support walls 17 and 19 in the width direction. Therefore, the connecting portion 15 prevents the lock arm 21 from being undesirably rolled up by an external force. Therefore, the connecting portion 15 prevents the lock arm 21 of the connector housing 10 from being plastically deformed by an external force.

The rear end 19*a* of one plate-shaped support wall 19 is set to be located further on a front side than the rear end 21*a* of the lock arm 21 in the fitting direction and the length L2 in the fitting direction is shorter than the length L1 in the fitting direction of the other plate-shaped support wall 17 set so that the rear end 17*a* is located further on a rear side than the rear end 21*a* of the lock arm 21 in the fitting direction. Therefore, as illustrated in FIGS. 7A and 7B, the lock operation space 16 having a cut formed at the rear end of the connecting portion 15 has an opening space W2 spread on one plate-shaped support wall 19 side. As a result, it becomes difficult for the finger 50 to hit one plate-shaped support wall 19 during unlocking operation. In particular, even when a width dimension of the upper wall 10*a* of the connector housing 10 becomes smaller and the gap W1 between the pair of plate-shaped support walls 17 and 19 is narrowed, it does not become difficult to press the finger 50 against the upper surface of the lock operation portion 23 at the rear portion of the lock arm 21. As a result, unlockability does not decrease.

The rear end 17*a* of the other plate-shaped support wall 17 is set to be located further on the rear side than the rear end 21*a* of the lock arm 21 in the fitting direction. Therefore, an undesired external force directed downward from above is not applied to the lock arm 21.

Therefore, even when the connector housing 10 is miniaturized, workability at the time of unlocking operation can be ensured.

According to the connector lock structure according to the embodiment, the upper surface of the lock operation portion 23 is entirely exposed from the lock operation space 16 in the top view. Therefore, during the unlocking operation, the finger 50 can easily press the lock operation portion 23.

Therefore, according to the connector lock structure according to the embodiment described above, it is possible to provide a lock structure of a compact connector capable of ensuring workability at the time of unlocking operation while protecting the lock arm 21.

The disclosure is not limited to the above-described embodiment and can be appropriately modified, improved, and the like. The material, shape, size, number, arrangement location, and the like of each component in the above-described embodiment are arbitrary and are not limited as long as the disclosure can be achieved.

Here, the features of the above-described embodiment of the connector lock structure according to the disclosure are briefly summarized as Items [1] to [3] listed below.

[1] A connector lock structure including: a lock arm (21) extending from a front end to a rear end in a fitting direction and formed on a side wall (upper wall 10*a*) of a connector housing (10), the lock arm (21) being configured to hold a fitted state by elastically engaging a counterpart connector housing (40); a pair of plate-shaped support walls (17, 19) provided at a rear portion of the side wall (upper wall 10*a*) to protrude from the side wall (upper wall 10*a*), the pair of plate-shaped support walls (17, 19) sandwiching a rear portion of the lock arm (21) therebetween; a connecting portion (15) that connects upper ends of the pair of plate-shaped support walls (17, 19) in a width direction to cross over the rear portion of the lock arm (21); and a lock operation space (16) having a cut formed at a rear end of the connecting portion (15), wherein a rear end (19*a*) of one (19) of the pair of plate-shaped support walls (17, 19) is located closer to the front end of the lock arm (21) than the rear end (21*a*) of the lock arm (21) in the fitting direction.

[2] The connector lock structure according to <1>, wherein the lock arm (21) includes a lock operation portion (23) provided on and protruding from an upper surface of the rear portion of the lock arm (21), and wherein an upper surface of the lock operation portion (23) is entirely exposed from the lock operation space (16) in a top view.

[3] The connector lock structure according to <1> or <2>, wherein the lock operation space (23) is configured to allow a finger (50) to press the rear portion of the lock arm (21).

According to the connector lock structure according to Item [1], when an undesired external force directed downward from above is applied to the lock arm, for example, when an object hits the lock arm, the external force is received by the pair of plate-shaped support walls provided to sandwich the rear portion of the lock arm therebetween. Therefore, the lock arm is prevented from being bent by an external force. Therefore, the pair of plate-shaped support walls prevent the situation in which an external force is applied to the lock arm of the connector housing and the bending of the lock arm itself disengages it from the counterpart connector housing, and further the fitted state is impaired from occurring.

When an undesired external force directed upward from below is applied to the lock arm, for example, when a rear portion of the lock arm is caught in an object, the external force is received by the connecting portion which connects the upper ends of the pair of plate-shaped support walls in the width direction. Therefore, the connecting portion prevents the lock arm from being undesirably rolled up by an external force. Therefore, the connecting portion prevents the lock arm of the connector housing from being plastically deformed by an external force.

The rear end of one plate-shaped support wall is located closer to the front end of the lock arm than the rear end of the lock arm in the fitting direction. A length of the one plate-shaped support wall in the fitting direction may be shorter than that of the other plate-shaped support wall set so that the rear end of the other plate-shaped support wall is located away from the front end of lock arm than the rear end of the lock arm in the fitting direction. Therefore, the lock operation space having a cut formed at the rear end of the connecting portion has an opening space spread on one plate-shaped support wall side. As a result, it becomes difficult for the operator to hit one plate-shaped support wall during unlocking operation. In particular, even when a width dimension of the side wall of the connector housing becomes smaller and a gap between the pair of plate-shaped support walls is narrowed, it does not become difficult to press the operator against the upper portion of the lock arm.

As a result, unlockability does not decrease. The rear end of the other plate-shaped support wall is set to be located further on the rear side than the rear end of the lock arm in the fitting direction. Therefore, an undesired external force directed downward from above is not applied to the lock arm. Therefore, even when the connector housing is miniaturized, workability at the time of unlocking operation can be ensured.

According to the connector lock structure according to Item [2], the upper surface of the lock operation portion is entirely exposed from the lock operation space in the top view. Therefore, during the unlocking operation, the operator can easily press the lock operation portion.

According to the connector lock structure according to Item [3], the lock operation space is configured to allow a finger to press the rear portion of the lock arm. Therefore, during the unlocking operation, the lock operation portion can easily pressed by the finger.

The invention claimed is:

1. A connector lock structure comprising:

a lock arm extending from a front end to a rear end in a fitting direction and formed on a side wall of a connector housing, the lock arm being configured to hold a fitted state by elastically engaging a counterpart connector housing;

a pair of plate-shaped support walls provided at a rear portion of the side wall to protrude from the side wall, the pair of plate-shaped support walls sandwiching a rear portion of the lock arm therebetween;

a connecting portion that connects upper ends of the pair of plate-shaped support walls in a width direction to cross over the rear portion of the lock arm; and a lock operation space having a cut formed at a rear end of the connecting portion, wherein a rear end of one of the pair of plate-shaped support walls is located closer to the front end of the lock arm than the rear end of the lock arm in the fitting direction.

2. The connector lock structure according to claim 1, wherein the lock arm comprises a lock operation portion provided on and protruding from an upper surface of the rear portion of the lock arm, and wherein an upper surface of the lock operation portion is entirely exposed from the lock operation space in a top view.

3. The connector lock structure according to claim 1, wherein the lock operation space is configured to allow a finger to press the rear portion of the lock arm.

4. The connector lock structure according to claim 1, wherein a first wall among the pair of plate-shaped support walls is shorter than a second wall among the pair of plate-shaped support walls.

5. The connector lock structure according to claim 1, wherein a rear end of a first wall among the pair of plate-shaped support walls is closer to the front end of the lock arm and a rear end of a second wall among the pair of plate-shaped support walls is closer to the rear end of the lock arm.

6. The connector lock structure according to claim 1, wherein the connection portion is provided above the rear portion of the lock arm.

7. The connector lock structure according to claim 1, wherein a rear end of a first wall among the pair of plate-shaped support walls is located closer to the front end of the lock arm than the rear end of the lock arm in the fitting direction, and wherein a rear end of a second wall among the pair of plate-shaped support walls is located farther from the front end of the lock arm than the rear end of the lock arm in the fitting direction.

* * * * *